US005199004A

United States Patent [19]

Monahan

[11] Patent Number: 5,199,004

[45] Date of Patent: Mar. 30, 1993

[54] SEALED ACOUSTICAL ELEMENT USING CONDUCTIVE EPOXY

[75] Inventor: Patrick J. Monahan, Gales Ferry, Conn.

[73] Assignee: The United States of America as represented by the Secretary of the Navy, Washington, D.C.

[21] Appl. No.: 892,056

[22] Filed: May 28, 1992

[51] Int. Cl.[5] ..... H04R 17/00

[52] U.S. Cl. ..... 367/157; 367/159; 310/334; 310/337; 310/369

[58] Field of Search ..... 367/157, 159, 140; 310/369, 337, 334

[56] References Cited

U.S. PATENT DOCUMENTS

| | | | |
|---|---|---|---|
| 3,716,828 | 2/1973 | Massa | 367/157 |
| 3,835,340 | 9/1974 | Schildkraut | 367/157 |
| 4,782,470 | 11/1988 | Poturnicki, Jr. et al. | 367/157 |
| 4,821,244 | 4/1989 | Wood | 367/159 |
| 4,866,683 | 9/1989 | Phillips | 367/157 |
| 4,933,919 | 6/1990 | Geil et al. | 367/159 |

*Primary Examiner*—J. Woodrow Eldred

*Attorney, Agent, or Firm*—Michael J. McGowan; Prithvi C. Lall; Michael F. Oglo

[57] ABSTRACT

A radially-polarized piezoelectric cylindrical transducer is provided. The transducer has an electrically conductive end cap affixed with a conductive epoxy to one end of a piezoelectric body and a second cap affixed to the other end. The piezoelectric body comprises a layer of piezoelectric material located between an inner and an outer electrode. The outer electrode has an electrode gap which electrically insulates the end cap from the outer electrode. The unit is electrically conductive and permits the attachment of two electrical leads to its exterior, one to the first end cap and the other to the outer electrode of the piezoelectric body. In an alternative embodiment, two conductive end caps are affixed with conductive epoxy to opposite ends of the piezoelectric body. In this embodiment, the inner electrode has an electrode gap which electrically insulates the second end cap from the inner electrode. One electrical lead attaches to each end cap in this alternative embodiment. An electrical signal sent through the piezoelectric transducer causes the walls of the cylinder to vibrate. Alternatively, pressure variations surrounding the transducer generate an electrical signal within the piezoelectric material of the transducer.

11 Claims, 1 Drawing Sheet

SEALED ACOUSTICAL ELEMENT USING CONDUCTIVE EPOXY

STATEMENT OF GOVERNMENT INTEREST

The invention described herein may be manufactured and used by or for the Government of the United States of America for Governmental purposes without the payment of any royalties thereon or therefor.

BACKGROUND OF THE INVENTION (1) Field of the Invention

The present invention relates generally to piezoelectric transducers and more specifically to a sealed acoustical element using conductive epoxy.

(2) Description of the Prior Art

Acoustic projectors and hydrophones for the underwater detection or transmission of acoustical signals typically employ radially-polarized piezoelectric transducers and hydrophones. These transducers and hydrophones generally comprise a piezoelectric cylinder with caps affixed to the ends of the cylinder. The cylinder comprises a layer of piezoelectric material located between an inner and an outer electrode. An electrical lead threaded through an opening in either the end cap or the wall of the cylinder provides the required electrical connection to the inner electrode of the transducer. The lead usually is soldered to the electrodes.

Piezoelectric transducers can either detect or transmit acoustical signals. During detection of acoustical signals, the signal being detected applies a pressure wave or other form of vibrating excitation to the exterior of the cylinder causing the cylinder to expand and contract mechanically in response to the applied excitation. The expansion and contraction of the cylinder produces a corresponding electrical charge, which is then transmitted to the electrodes of the piezoelectric cylinder. During transmission of acoustical signals, an electric signal of appropriate magnitude and frequency is sent to the electrodes of the piezoelectric cylinder and excites the piezoelectric layer, thereby causing the cylindrical walls to expand and contract radially. Expansion and contraction of the cylindrical walls then transmit vibrating waves across an acoustical medium such as water.

In underwater acoustical projectors and hydrophones, a rubber housing or "boot" filled with an insulating liquid surrounds the piezoelectric transducer and prevents sea water permeation. The insulating liquid electrically insulates the transducer and also dissipates heat. One concern arising for underwater devices is the potential for leaks which can occur around the internally connected electrical leads resulting in the development of electrical shorts and a reduction in the operational life of the device.

For example, the prior art in U.S. Pat. No. 4,782,470 by Poturnicki et al. discloses a hydrophone which comprises a pair of piezoelectric cylinders bonded end to end with epoxy. Each end of the composite cylinder has a ceramic cap attached, and one of these caps has a central openings for entry of a cable having two electrical leads. The leads are soldered to terminals located on a plug affixed to the interior of the cap.

Wood in U.S. Pat. No. 4,821,244 discloses a tubular acoustic projector for underwater use having a configuration similar to Poturnicki. The acoustic projector comprises a cylindrical piezoelectric transducer with end closures. One of the end closures includes a tube connected to a flat disk having either two or four bores. Electrical leads pass through the tube and the bores to the interior of the piezoelectric cylinder and are soldered to the side wall and the other end closure of the transducer.

Geil et al. in U.S. Pat. No. 4,933,919 discloses a hydrophone with an alternative configuration. The hydrophone comprises a pair of piezoelectric cylinders arranged end to end and having ceramic end caps. Each cylinder has a notch along its side wall, and the notches are aligned to meet in the center of the stacked cylinders so as to create an opening. In this embodiment, a pair of electrical leads pass through the opening in the side wall instead of the end cap and connect to the interior of the cylinder.

Shirley et al. in U.S. Pat. No. 4,565,645 also disclose an acoustic transducer comprising two metallic end caps affixed to a piezoelectric cylinder and an outer cylinder. The piezoelectric cylinder comprises a layer of piezoelectric material located between an inner and an outer electrode. A non-conductive bonding agent bonds the metallic end caps and the outer cylinder to the piezoelectric cylinder. In addition, the bonding agent electrically insulates the end caps and outer cylinder from the piezoelectric cylinder. Shirley et al., however, do not describe the internal electrical connection of the electrodes to either of the end caps. Instead, Shirley et al. concentrate on disclosing a mechanically rigid cylinder with high sensitivity and low resonance frequency.

All of these prior art devices require interior electrical leads within the piezoelectric cylinder which raises the flexibility and ultimately the acoustic performance of the transducer. For example, both Poturnicki and Wood require soldering the leads to the interior of the transducer. This soldering increases the risk of depolarization of the piezoelectric cylinder and alters its aging curve. The hydrophone of Geil et al., on the other hand, while not using solder, still has reduced acoustic performance because its configuration is susceptible to leaks around the entry of the electrical leads. Shirley et al., although not describing an internal electrical connection, would seemingly require an internal connection because of its use of non-conductive epoxy. Internally-connected electrical leads also increase the difficulty of fabrication and repair of the piezoelectric transducers.

SUMMARY OF THE INVENTION

An object of the present invention is to provide an acoustical element permitting exterior attachment of electrical leads to the piezoelectric element.

Another object of the present invention is to improve the acoustic performance of a piezoelectric transducer through greater flexibility of the piezoelectric body by eliminating an internally connected electrical lead and any solder required for securing such lead to an inner electrode of the transducer.

Yet another object of the present invention is to maintain polarization of the piezoelectric transducer and to maintain the aging curve of the piezoelectric transducer by eliminating the process of soldering an electrical lead to the inner and outer electrode. This will reduce the mass loading of a relatively small cylinder.

Another object of the present invention is to reduce the mass loaded on the piezoelectric body by eliminating the need of solder.

A further object of the present invention is to provide for simplified fabrication and repair of a radially-poled piezoelectric transducer.

The present invention attains the foregoing and additional objects by providing a radially-polarized piezoelectric transducer. The apparatus comprises an electrically conductive end cap, a conductive epoxy, a piezoelectric body, and a means for sealing the piezoelectric body. The piezoelectric body connects at one end both electrically and structurally to the electrically conductive end cap by means of the conductive epoxy. The means for sealing said piezoelectric body connects to the other end of the body so as to provide an enclosed area within the apparatus. The piezoelectric body comprises an inner electrode, an outer electrode, and a piezoelectric material. The inner electrode is electrically connected to the conductive end cap by use of the conductive epoxy. The piezoelectric material surrounds the inner electrode and is electrically connected to the inner electrode and the outer electrode. The outer electrode surrounds the piezoelectric material and is positioned such that an insulating electrode gap exists between the electrically conductive end cap and the outer electrode. A first electrical lead connects to the transducer at the electrically conductive end cap and a second electrical lead connects to the outer electrode.

In an alternative embodiment, the means for sealing comprises a second electrically conductive end cap. In this embodiment, the first end cap attaches to one end of the piezoelectric body in the same manner as the first embodiment. The second end cap, however, attaches to the other end of the piezoelectric body in a reverse manner. In other words, the second end cap is connected electrically by means of the conductive epoxy to the outer electrode. A gap located between the second end cap and the inner electrode provides electrical insulation. One electrical lead connects electrically to each conductive end cap.

BRIEF DESCRIPTION OF THE DRAWINGS

The above and numerous other objects of the invention that may be achieved by the embodiment of the invention will be more readily understood from the following detailed description and the appended drawings wherein.

DESCRIPTION OF THE PREFERRED EMBODIMENTS

Figure 1:
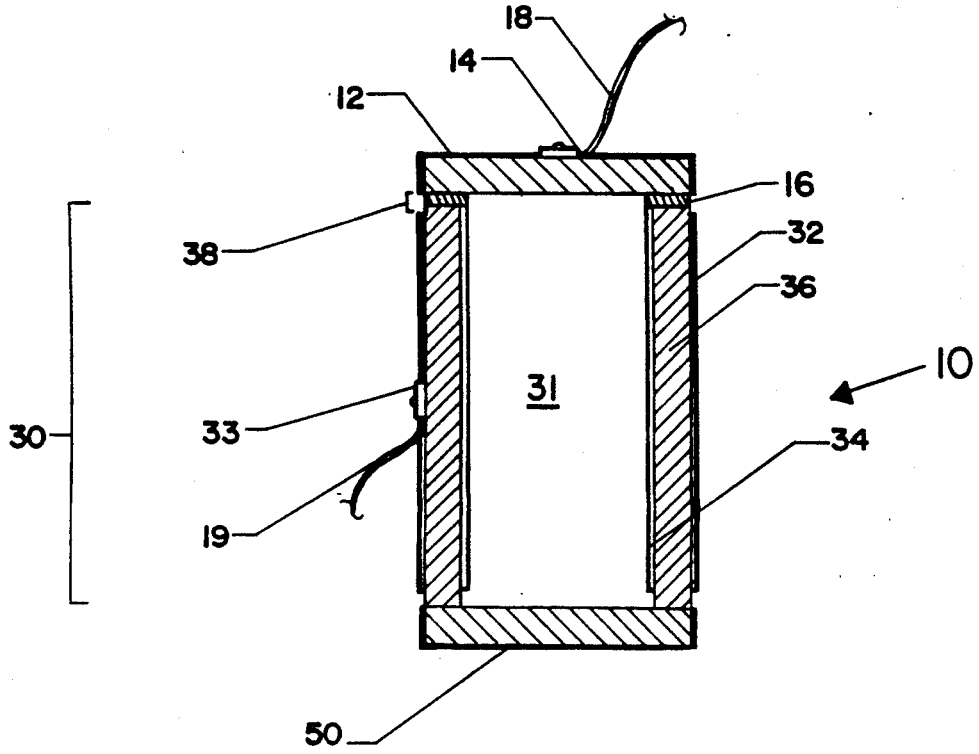
FIG. 1 is a cross-sectional view of the present invention showing a piezoelectric transducer having one electrically conductive end cap.

Referring now to FIG. 1, a cross-sectional view of the present invention, designated generally by the reference numeral 10, shows the structural relationship of the elements. The invention comprises an electrically conductive end cap 12, a conductive epoxy 16, a piezoelectric body 30, and a means for sealing the piezoelectric body 50. For illustrative purposes, FIG. 1 shows the conductive epoxy as a thicker material than its actual size. The piezoelectric body has an enclosure 31 and comprises an outer means for conducting electric current or electrode 32, an inner means for conducting electric current or electrode 34, and a piezoelectric material 36. The piezoelectric material 36 surrounds the inner electrode 34, and the outer electrode 32 surrounds the piezoelectric material 36.

The apparatus is assembled first by using the conductive epoxy 16 to bond the conductive end cap 12 to one end of the piezoelectric body 30. The conductive epoxy 16 also electrically connects the conductive end cap 12 to the inner electrode 34 and the piezoelectric material 36. A gap 38 located between the outer electrode 32 and the conductive end cap 12 electrically insulates the outer electrode from the end cap. This gap 38 is typically accomplished by removing a small band of the material forming the outer electrode 32 at the end of the piezoelectric body where the conductive end cap 12 attaches.

A first electrical lead 18 attaches at point 14 to the end cap 12 by means of solder or conductive epoxy. A second electrical lead 19 attaches at point 33 to the outer electrode 32 of the piezoelectric body 30 also by means of solder or conductive epoxy.

Piezoelectric transducers can both receive electrical signals and convert them to acoustical signals or receive acoustical signals and convert these signals to electrical signals. For illustration, an electrical signal sent to the first electrical lead 18 flows through the electrically conductive end cap 12 and the conductive epoxy 16 to the inner electrode 34 of the piezoelectric body 30. The signal then flows radially from the inner electrode 34 through the piezoelectric material 36 to the outer electrode 32 and then to the second electrical lead 19 by means of solder or conductive epoxy placed at point 33. As the signal traverses the piezoelectric material, it causes the piezoelectric body 30 to vibrate, thus emitting acoustical signals. Alternatively, acoustical signals emitted from another source create pressure variations in the water surrounding the transducer, causing the walls of the cylinder to vibrate. The vibrating piezoelectric material 36 generates an electrical signal which then flows from the inner electrode through the conductive epoxy and conductive end cap to the electrical lead.

Figure 2:
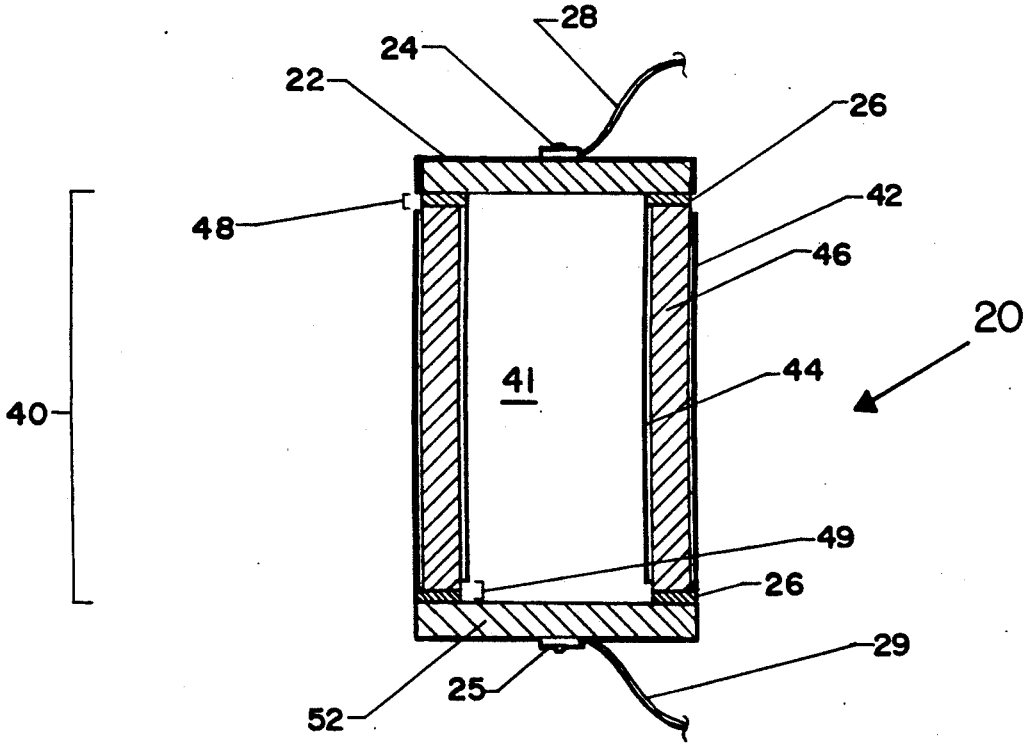
FIG. 2 is a cross-sectional view of an alternative embodiment of the piezoelectric transducer having a second electrically conductive end cap.

Referring now to FIG. 2, a cross-sectional view of an alternative embodiment of the present invention, designated generally by reference numeral 20, shows the structural relationship of the elements. The apparatus comprises a first electrically conductive end cap 22, a conductive epoxy 26, a piezoelectric body 40, and a second electrically conductive end cap 52. For illustrative purposes, FIG. 2 shows the conductive epoxy 26 as a thicker material than its actual size. The piezoelectric body 40 has an enclosure 41 and comprises an outer means for conducting electric current or electrode 42, an inner means for conducting electric current or electrode 44, and a piezoelectric material 46 located between the two electrodes. The first electrically conductive end cap 22 attaches to one end of the piezoelectric body 40 in a manner similar to the embodiment described in FIG. 1. That is, the conductive epoxy 26 bonds the conductive end cap 22 to one end of the piezoelectric body 40. The conductive epoxy also electrically connects the conductive end cap 22 to the inner electrode 44 and the piezoelectric material 46. Gap 48 located between the outer electrode 42 and the conductive end cap 22 electrically insulates the inner electrode from the end cap. This gap 48 is typically accomplished by removing a small band of the material forming the outer electrode 42 at the end of the piezoelectric body where the first conductive end cap attaches. A first electrical lead 28 attaches at point 24 to the end cap 22 by means of solder or conductive epoxy.

The second electrically conductive end cap 52 attaches to the other end of the piezoelectric body in a manner reverse to the connections of the first end cap. In other words, the conductive epoxy 26 electrically connects the second conductive end cap 52 to the outer electrode 42 and the piezoelectric material 46. Gp 49 located between the inner electrode 44 and the second conductive end cap 52 electrically insulates the inner electrode from the end cap 52. This gap 49 is also typically accomplished by removing a small band of the material forming the inner electrode 44 at the end of the piezoelectric body where the second conductive end cap attaches. A second electrical lead 29 attaches at point 25 to the second end cap 52.

The piezoelectric transducer in the alternative embodiment functions as follows. An electrical signal applied to the first electrical lead 28 flows through the first electrically active end cap 22 to the inner electrode 44 of the piezoelectric cylinder 40 by means of the conductive epoxy 26. The signal then flows radially from the inner electrode 44 through the piezoelectric material 46 to the outer electrode 42 of the piezoelectric cylinder 40 and to the second end cap 52 through the conductive epoxy 26. The signal flows finally through the electrically active second end cap 52 to the second electrical lead 29.

Preferably, the electrically conductive end caps 22 and 52 are made of brass or of another material that has a thermal coefficient of expansion similar to the piezoelectric material's thermal coefficient of expansion. Also, the conductive epoxy is preferably a metallic-based epoxy and, preferably, the piezoelectric bodies 30 and 40 including the electrodes as well as the piezoelectric material are all cylindrical in shape.

The novel features of this invention include the use of conductive epoxy for structural bonding and for electrical connection and the placement of a gap between the electrodes and the end caps for electrical insulation. The benefits and advantages of these features include the elimination of an opening in either the end cap or the wall of the transducer for the entry of electrical leads and the absence of potential leaks during underwater use. Other benefits and advantages include obviating the process of soldering an electrical lead to the inner electrode of the cylinder and thereby eliminating the risk of depolarization while also simplifying the fabrication and repair of a piezoelectric transducer.

It will be understood that many additional changes in the details, materials, steps and arrangement of parts, which have been herein described and illustrated in order to explain the nature of the invention, may be made by those skilled in the art within the principle and scope of the invention as expressed in the appended claims.

What is claimed is:

1. A sealed piezoelectric transducer comprising:

an electrically conductive end cap;

a metallic-based conductive epoxy, said conductive epoxy bonding to said end cap and being electrically connecting to said end cap;

a piezoelectric body having an enclosure, said piezoelectric body being connected at one end to said end cap and being electrically connected to said conductive epoxy, said piezoelectric body further including an inner means for conducting electric current, said inner means being electrically connected to said conductive epoxy, a piezoelectric material, aid material surrounding said inner means for conducting, an outer means for conducting electric current, said outer means surrounding said piezoelectric material and being insulated electrically for said end cap by an electrode gap located between said outer means for conducting and said end cap; and a means for sealing the enclosure of said piezoelectric body, said means for sealing being connected at the other end of said piezoelectric body.

2. A sealed piezoelectric transducer as recited in claim 1 wherein said end cap is made of a material having a thermal coefficient of expansion similar to the thermal coefficient of expansion of the piezoelectric material.

3. A sealed piezoelectric transducer as recited in claim 1 further comprising an electrical lead electrically connected to said end cap.

4. A sealed piezoelectric transducer as recited in claim 3 further comprising a second electrical lead electrically connected to said outer means for conducting electric current.

5. A sealed piezoelectric transducer as recited in claim 1 wherein said means for sealing said piezoelectric body includes a second electrically conductive end cap.

6. A sealed piezoelectric transducer as recited in claim 5 wherein said piezoelectric body further comprises:

an inner electrode connected electrically to said first end cap by use of said conductive epoxy and insulated electrically from said second end cap by an electrode gap located between said inner electrode and said second end cap;

a piezoelectric material, said material surrounding said inner electrode and being electrically connected to said inner electrode; and an outer electrode connected electrically to and surrounding said piezoelectric material, said outer electrode being insulated electrically from said first end cap by a second electrode gap located between said outer electrode and said first end cap.

7. A sealed piezoelectric transducer as recited in claim 5 wherein said first end cap and said second end cap are made of brass.

8. A sealed piezoelectric transducer as recited in claim 6 wherein said first end cap and said second end cap are made of a material having a thermal coefficient of expansion similar to the thermal coefficient of expansion of the piezoelectric material.

9. A sealed piezoelectric transducer as recited in claim 5 wherein said conductive epoxy is metallic-based.

10. A sealed piezoelectric transducer as recited in claim 5 further comprising an electrical lead electrically connected to said first end cap.

11. A sealed piezoelectric transducer as recited in claim 10 further comprising a second electrical lead electrically connected to said second end cap.

* * * * *